US006256471B1

(12) United States Patent
Sato et al.

(10) Patent No.: US 6,256,471 B1
(45) Date of Patent: Jul. 3, 2001

(54) IMAGE DEVELOPING DEVICE AND IMAGE FORMING APPARATUS

(75) Inventors: Shougo Sato, Seto; Mitsuru Horinoe, Aichi-Ken, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/516,765

(22) Filed: Mar. 1, 2000

(30) Foreign Application Priority Data

| | | |
|---|---|---|
| Mar. 11, 1999 | (JP) | 11-065034 |
| Mar. 17, 1999 | (JP) | 11-071446 |
| Mar. 23, 1999 | (JP) | 11-078569 |
| Mar. 26, 1999 | (JP) | 11-084021 |

(51) Int. Cl.[7] ..... G03G 15/08

(52) U.S. Cl. ..... 399/284; 399/27; 399/265; 430/110

(58) Field of Search ..... 399/284, 265, 399/279, 27, 113, 111; 430/120, 109, 110

(56) References Cited

U.S. PATENT DOCUMENTS

| | | | | |
|---|---|---|---|---|
| 5,508,795 | * | 4/1996 | Kikuchi | 399/27 |
| 5,604,071 | * | 2/1997 | Okado et al. | 430/110 |
| 5,604,074 | * | 2/1997 | Yasuda et al. | 430/120 |
| 5,745,824 | * | 4/1998 | Yashiro | 399/113 |
| 5,752,134 | * | 5/1998 | Hazama et al. | 399/113 |
| 5,783,347 | * | 7/1998 | Ikami | 430/110 |
| 5,867,758 | * | 2/1999 | Yoshida et al. | 399/284 |
| 6,042,979 | * | 3/2000 | Ohishi et al. | 430/110 X |
| 6,049,688 | * | 4/2000 | Hayashi et al. | 399/284 |
| 6,058,284 | * | 5/2000 | Okano et al. | 399/284 |
| 6,125,250 | * | 9/2000 | Kamio et al. | 399/284 X |

FOREIGN PATENT DOCUMENTS

| | | | |
|---|---|---|---|
| 0 390 605 A2 | | 10/1990 | (EP) . |
| 0 859 291 A2 | | 8/1998 | (EP) . |
| 06059528 | | 3/1994 | (JP) . |
| 6-273967 | * | 9/1994 | (JP) . |
| 8-022140 | * | 1/1996 | (JP) . |
| 9-146370 | * | 6/1997 | (JP) . |
| 9-160380 | * | 6/1997 | (JP) . |
| 10213920 | | 8/1998 | (JP) . |

* cited by examiner

*Primary Examiner*—Sophia S. Chen
(74) *Attorney, Agent, or Firm*—Oliff & Berridge, PLC

(57) ABSTRACT

The invention concerns a pressing portion of a layer thickness-regulating blade for pressing toner on a developing roller and forming a thin layer of toner is formed from a silicone rubber. The pressing force of the pressing portion is set to 15–30 gf/cm. Since toner is pressed against the developing roller by the portion made of the silicone rubber having a high electrical charging characteristic, toner is sufficiently electrically charged. Furthermore, since the pressing force or pressure of the pressing portion is very weak, the abrasion of the silicone rubber-made portion is reduced.

30 Claims, 6 Drawing Sheets

IMAGE DEVELOPING DEVICE AND IMAGE FORMING APPARATUS

BACKGROUND OF THE INVENTION

1. Field of Invention

The present invention relates to a technology for forming a thin layer of toner on a developing roller that supplies toner to a photosensitive drum.

2. Description of Related Art

A typical laser printer that uses a non-magnetic single-component toner has a developing roller that carries thereon the toner, a layer thickness-regulating blade disposed at a side of the developing roller for forming a thin toner layer on the developing roller, and a photosensitive drum disposed facing the developing roller, on which drum an electrostatic latent image is formed.

The layer thickness-regulating blade is pressed against a surface of the developing roller. Toner supplied onto the developing roller is rubbed between the layer thickness-regulating blade and the developing roller, so that toner is sufficiently electrically charged and, at the same time, is placed as a thin layer of a predetermined thickness on the developing roller. An electrostatic latent image is formed on the photosensitive roller by uniformly electrically charging the surface of the photosensitive roller through the use of an electrical charging device and then irradiating the surface with a laser beam based on predetermined image data through the use of a laser emitting device. Thus-electrically charged toner is transferred selectively to the electrostatic latent image on the photosensitive roller, thereby developing the image.

However, to develop an image of a toner of a single non-magnetic component, the electrical charging of toner is carried out substantially entirely by friction contact between the layer thickness-regulating blade and the developing roller. Therefore, to uniformly charge the toner, it is necessary to quite strongly rub the toner by strongly pressing the layer thickness-regulating blade against the developing roller. In order to improve the flowability and the stability of the electrical charge, an external additive made of fine powder of silica, alumina, titanium oxide or the like is added to a toner. Therefore, if the toner is rubbed excessively strongly, particles of the external additive become sunk in toner matrix particles, so that the flowability decreases or the electrical charging characteristic of toner decreases.

SUMMARY OF THE INVENTION

To solve the aforementioned problems, the invention adopts a silicone rubber having a good electrical charging characteristic as a material of a pressing portion of a layer thickness-regulating member. At the silicone rubber-made pressing portion, the layer thickness-regulating member presses a developing agent on a developing agent carrier. The pressing force with which the pressing portion presses the developing agent is as weak as about 15–30 gf/cm, so that the abrasion of the silicone rubber-made pressing portion is reduced. Therefore, the electrical charging characteristic of the developing agent is prevented from deteriorating, so that high image quality can be maintained. Furthermore, the life span of a developing device is extended, so that the running cost will decrease.

The developing agent may be a polymerized toner. The polymerized toner achieves a very good flowability. Therefore, the friction resistance that occurs when the developing agent is rubbed between the pressing portion and the developing agent carrier is reduced. If a very weak pressing force is set for the pressing portion as in the invention, the pressing force is likely to fluctuate depending on various conditions. Fluctuation of the pressing force impedes stable friction electrical charging of the developing agent. However, if a polymerized toner having high flowability is adopted, the adverse effect of fluctuation of the pressing force can be ignored, so that stable development becomes possible.

Furthermore, the developing agent may contain at least two kinds of external additives that are different in particle size. In that case, relatively large external additive particles function as spacers. That is, relatively large particles and relatively small particles of the external additives simultaneously adhere to particles of the developing agent, and relatively large external additive particles prevent relatively small external additive particles from being sunk into particles of the developing agent when the developing agent particles collide. In particular, if the relatively large-particle external additive has a BET specific surface area less than 100 $m^2/g$ based on nitrogen adsorption, the sinking of relatively small external additive particles can be effectively prevented, so that good flowability of the developing agent can be ensured.

Such use of a large-particle external additive is not feasible according to the conventional art, because a toner containing such a large-particle external additive accelerates the abrasion of the silicone rubber. In the invention, however, the adoption of a polymerized toner curbs the abrasion of the silicone rubber, and therefore allows a large-particle external additive to be contained in the toner.

BRIEF DESCRIPTION OF THE DRAWINGS

Preferred embodiments of the invention will be described in detail with reference to the following figures wherein.

DETAILED DESCRIPTION OF PREFERRED EMBODIMENTS

Figure 1:
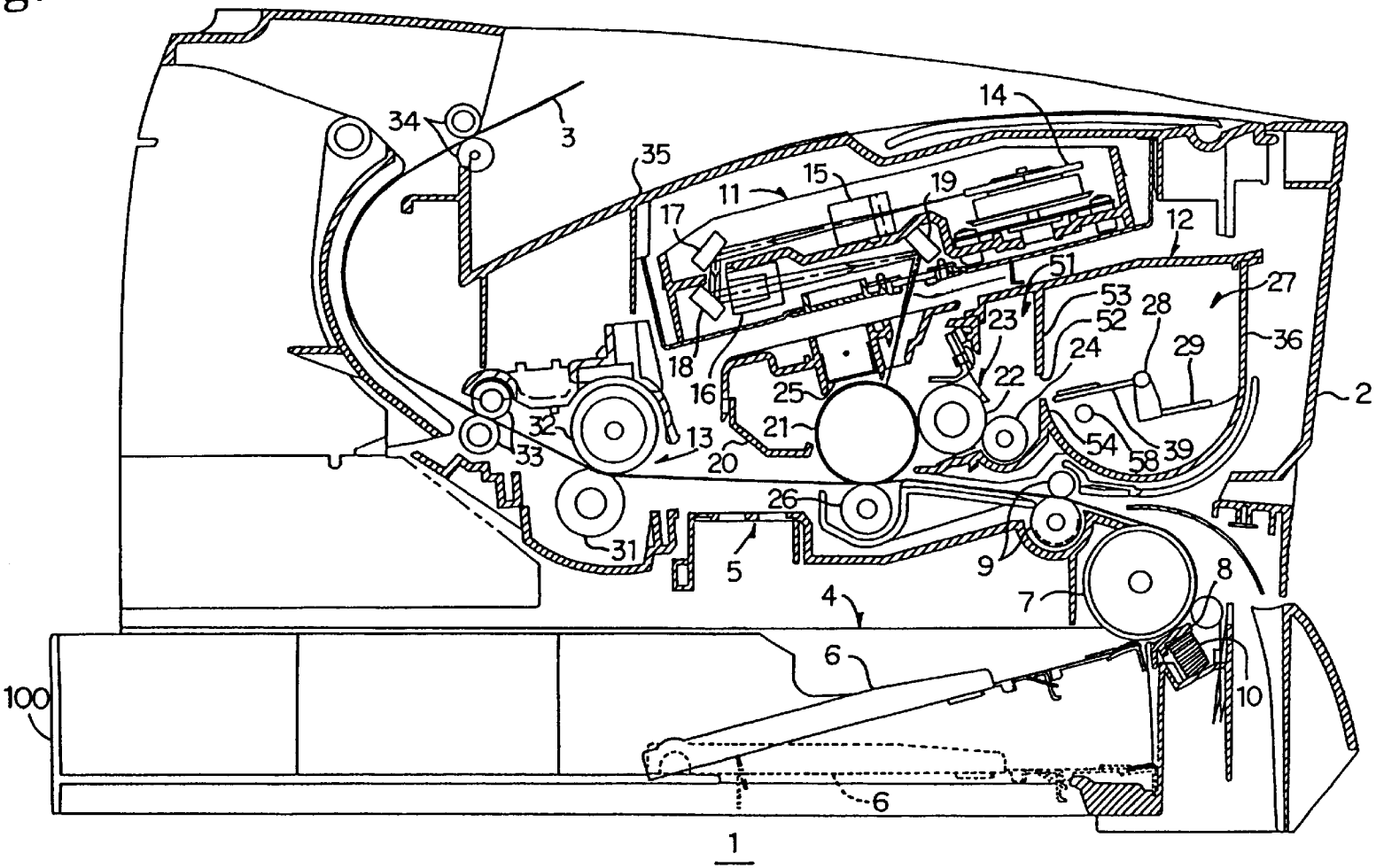
FIG. 1 is a side sectional view of a laser printer.

Referring to FIG. 1, a laser printer 1 has, in a body casing 2, a feeder unit 4 for supplying print sheets 3, and an image forming unit 5 for forming a predetermined image on a print sheet 3 supplied thereto.

The feeder unit 4 is substantially made up of a sheet feed tray 100 that is detachably attached to a bottom portion of the body casing 2, a sheet pressing plate 6 provided in the sheet feed tray 100, a sheet feed roller 7 and a sheet feed pad 8 that are provided above an end portion of the sheet feed tray 100, and register rollers 9 provided downstream (in the sheet conveying direction) of the sheet feeder roller 7.

The sheet pressing plate 6 allows print sheets 3 to be stacked thereon. An end portion of the sheet pressing plate 6 remote from the sheet feeder roller 7 is turnably supported so that another end portion of the sheet pressing plate 6 closer to the sheet feeder roller 7 is movable up and down. The sheet pressing plate 6 is urged upward from its reverse side by a spring (not shown). When the stack of print sheets 3 is increased in quantity, the sheet pressing plate 6 is turned downward about the end of the sheet pressing plate 6 remote from the sheet feeder roller 7, against the urging force from the spring. The sheet feeder roller 7 and the sheet feed pad 8 are disposed facing each other. The sheet feed pad 8 is urged toward the sheet feeder roller 7 by a spring 10 that is disposed on the reverse side of the sheet feed pad 8. An uppermost print sheet 3 in the stack on the sheet pressing plate 6 is pressed against the sheet feeder roller 7 by the spring provided on the reverse side of the sheet pressing plate 6, and is clamped between the sheet feeder roller 7 and the sheet feed pad 8 due to rotation of the sheet feeder roller 7. After that, the print sheet 3 is fed in. Thus, print sheets 3 are fed in one sheet at a time. The register rollers 9 are made up of two rollers, that is, a driving roller and a driven roller. The register rollers 9 register the print sheet 3 conveyed from the sheet feeder roller 7, in a predetermined manner, and then convey the print sheet 3 to the image forming unit 5.

The image forming unit 5 includes a scanning unit 11, a developing unit 12, and a fixing unit 13.

The scanning unit 11 is provided in an upper portion of an internal space of the body casing 2. The scanning unit 11 has a laser emitting portion (not shown), a rotatable polygonal mirror 14, lenses 15, 16, and reflecting mirrors 17, 18, 19. A laser beam L that is emitted from the laser emitting portion based on predetermined image data sequentially passes through or is reflected by the optical elements, that is, the polygonal mirror 14, the lens 15, the reflecting mirrors 17, 18, the lens 16, and the reflecting mirror 19 in that order as indicated by a broken line. The laser beam is thus directed to and high-speed scanned over a photosensitive drum 21 of the developing unit 12 (described later) for irradiation of the surface of the photosensitive drum 21.

The developing unit 12 will be described with reference to FIG. 2. The developing unit 12 is disposed below the scanning unit 11. The developing unit 12 includes the photosensitive drum 21, a developing cartridge 36, a scorotron electrical charging device 25, and a transfer roller 26 that are contained in a drum cartridge 20 that is detachably attachable to the body casing 2. The developing cartridge 36 is detachably attached to the drum cartridge 20, and has a developing roller 22, a layer thickness-regulating blade 23, a supplying roller 24, and a toner box 27.

An internal space of the developing cartridge 36 is divided into a developing chamber 51 that contains the developing roller 22, the layer thickness-regulating blade 23 and the supplying roller 24, and into the toner box 27 containing toner. The developing chamber 51 and the toner box 27 are separated by an upper partition 53 and a lower partition 54. Formed between the upper partition 53 and the lower partition 54 is a generally rectangular opening 52 that extends in the direction of width of the developing cartridge 36. The opening 52 is formed so that toner present in the toner box 27 and toner present in the developing chamber 51 can move back and forth through the opening 52. Thus, toner is allowed to move between the toner box 27 and the developing chamber 51 through the opening 52.

The developing cartridge 36 is detachably attachable to the drum cartridge 20. By replacing the developing cartridge 36, replacement of the layer thickness-regulating blade 23 and toner replenishment can be simultaneously carried out. Replacement of the developing cartridge 36 and replacement of the layer thickness-regulating blade 23 may be performed separately. Typically, the life span of the photosensitive drum 21 exceeds the number of printed sheets needed to consume the entire amount of toner stored in the toner box 27, so that when the entire amount of toner in the toner box 27 is consumed, the photosensitive drum 21 is still usable and does not need to be replaced. It is to be noted that the developing cartridge 36 and the drum cartridge 20 are described in detail in U.S. Pat. No. 6,041,203, issued Mar. 21, 2000 which is incorporated by reference in its entirety.

The toner box 27 contains an electrically insulative and positively electrically charged toner of a single non-magnetic component. Use of a positively electrically charged toner allows reversal development on a positively electrically charged surface of the photosensitive drum 21.

If a negatively electrically charged toner is used, the photosensitive drum 21 needs to be negatively electrically charged. If the photosensitive drum 21 is negatively electrically charged by using the scorotron electrical charging device 25 while the scorotron electrical charging device 25 is not in contact with the photosensitive drum 21, ozone is produced in large amounts. If the photosensitive drum 21 is electrically charged with an electrically conductive roller or brush being in contact with the photosensitive drum 21 in order to prevent production of ozone, non-uniform electrical charging may result on the photosensitive drum 21.

In a case where the photosensitive drum 21 is positively electrically charged, electrically charging the photosensitive drum 21 through the use of the scorotron electrical charging device 25 while the electrical charging device 25 and the photosensitive drum 21 are not in contact produces only a very small amount of ozone, and achieves uniform electrical charging of the photosensitive drum 21. Therefore, the adoption of a positively electrically charged toner reduces production of ozone, and achieves uniform image development.

The toner T used in this embodiment is a polymerized toner made by adding an external additive that is fine powder of silica, alumina, titanium oxide or the like, to a main component that is toner matrix particles formed by adding a coloring agent, such as carbon black or the like, a charge control agent, such as nigrosine or the like, wax, and the like to spherical styrene-acryl-based resin particles obtained through copolymerization, based on a known polymerization method, such as suspension polymerization or the like, of polymerizable monomers, for example, styrene-based monomers, such as styrene and the like, and acryl-based monomers, such as acrylic acid, alkyl (C1–C4) acrylate, alkyl (C1–C4) methacrylate and the like. The particle shape of such a polymerized toner is closer to a perfect sphere than the particle shape of a pulverized toner, so that the flowability of the polymerized toner is very good. The polymerized toner has an improved flowability and an improved electrical charging stability due to addition of the external additive such as silica or the like. The mean particle size of the polymerized toner is about 7–10 $\mu$m. With regard to the external additive, this embodiment uses two kinds of silica, that is, silica having a BET specific surface area of 200 $m^2/g$, and silica having a BET specific surface area of 50 $m^2/g$. The smaller silica particles of a BET specific surface of 200 $m^2/g$ increase the flowability of the toner, and the larger silica particles of a BET specific surface of 50 $m^2/g$ substantially prevent the smaller silica particles from being sunk in toner matrix particles.

Toner inside the toner box 27 is stirred by an agitator 29 that is supported by a rotating shaft 28 provided at a center of the toner box 27, and is discharged into the developing chamber 51 via the opening 52.

The supplying roller 24 is disposed in a portion of the developing chamber 51 close to the opening 52, in such a manner that the supplying roller 24 is rotatable in a direction indicated by an arrow (counterclockwise). The developing roller 22 is disposed facing the supplying roller 24, in such a manner that the developing roller 22 is rotatable in a direction indicated by an arrow (counterclockwise). The supplying roller 24 and the developing roller 22 are disposed in contact with each other so that they are press-deformed against each other to an appropriate extent.

The supplying roller 24 is formed by covering a metallic roller shaft with a roller part formed from an electrically conductive foam material.

The developing roller 22 is formed by covering a metallic roller shaft with a roller part formed by an electrically conductive elastic solid. More specifically, the roller part of the developing roller 22 is formed by coating a roller body formed from an electrically conductive urethane or silicone rubber containing fine carbon powder, or the like, with a coat layer formed from a urethane or silicone rubber containing fluorine. The surface roughness of the coat layer is set to 3–5 $\mu$m in 10-point mean roughness Rz, which is less than the mean particle size of the toner. The developing roller 22 is supplied with a bias so as to produce an electric potential difference between the developing roller 22 and the photosensitive drum 21. The developing roller 22 is designed so that the resistance from the shaft core to the surface of the developing roller 22 becomes about $10^4$–$10^8$ Ω.

The layer thickness-regulating blade 23 is disposed near the developing roller 22. The layer thickness-regulating blade 23 has a blade body 37 that is formed by a stainless steel plate spring member, and a pressing portion 38 that is disposed on a distal end portion of the blade body 37 and that is formed from an electrically insulative silicone rubber into a semicircular shape in section. The blade body 37 is supported, at an end portion thereof opposite from the pressing portion 38, to a portion of the developing cartridge 36 that is near the developing roller 22. Due to the elastic force of the blade body 37, the pressing portion 38 is pressed against the developing roller 22.

Toner discharged into the developing chamber 51 via the opening 52 is supplied to the developing roller 22 as the supplying roller 24 rotates. Toner is positively electrically charged between the supplying roller 24 and the developing roller 22 due to friction. After being supplied onto the developing roller 22, toner enters a gap between the developing roller 22 and the pressing portion 38 of the layer thickness-regulating blade 23 as the developing roller 22 rotates. Toner is rubbed between the pressing portion 38 and the developing roller 22 and, due to friction, becomes sufficiently electrically charged, and is formed into a thin layer of a predetermined thickness on the developing roller 22. It is to be noted that when toner is rubbed between the developing roller 22 and the pressing portion 38 of the layer thickness-regulating blade 23, silica particles added externally to toner matrix particles become sunk in the toner matrix particles, so that the flowability or electrical charging characteristic of toner decreases. Furthermore, a portion of the amount of toner carried on the developing roller 22 is consumed for image development, and the rest is not used for development but is returned into the developing chamber 51.

The photosensitive drum 21 is disposed at a position sideways from the developing roller 22 in such a manner that the photosensitive drum 21 faces the developing roller 22 and is rotatable in a direction indicated by an arrow (clockwise). A drum body of the photosensitive drum 21 is grounded, and a surface portion of the photosensitive drum 21 is formed from a positively electrically charged organic photosensitive material containing a polycarbonate as a main component. The scorotron electrical charging device 25 is disposed at a predetermined interval upward from the photosensitive drum 21. The scorotron electrical charging device 25 is a positively charging electrical charging device that produces corona discharge from a tungsten wire. The scorotron electrical charging device 25 positively charges the surface of the photosensitive drum 21 uniformly.

After being uniformly positively charged by the scorotron electrical charging device 25, the surface of the photosensitive drum 21 is exposed to a laser beam L emitted from the scanning unit 11 so that an electrostatic latent image is formed based on predetermined image data. When positively charged toner carried on the developing roller 22 come to face and contact the photosensitive drum 21 as the developing roller 22 rotates, the toner is selectively transferred and deposited onto the electrostatic latent image formed on the surface of the photosensitive drum 21, that is, portions of the positively charged surface of the photosensitive drum 21 that have a reduced electric potential due to exposure to the laser beam, so that the image is visualized. Thus, image development (reversal development) is accomplished.

The transfer roller 26 is disposed rotatably in a direction indicated by an arrow (counterclockwise) below the photosensitive drum 21, facing the photosensitive drum 21. The transfer roller 26 is formed by covering a metallic roller shaft with a roller part formed from an electrically conductive rubber material. A predetermined transfer bias is applied to the transfer roller 26. Therefore, the toner image developed on the photosensitive drum 21 is transferred to the print sheet 3 due to the transfer bias when the print sheet 3 is conveyed between the photosensitive drum 21 and the transfer roller 26.

The fixing unit 13 is disposed sideways from the developing unit 12, that is, downstream thereof, as shown in FIG. 1. The fixing unit 13 has a heat roller 32, a pressing roller 31 pressed against the heat roller 32, and a pair of conveying rollers 33 provided downstream of the heat roller 32 and the pressing roller 31. The heat roller 32 is typically equipped with a heating halogen lamp that is disposed in an aluminum tube. A surface of the heat roller 32 is coated with a fluorocarbon resin so as to prevent fusion of toner onto the surface. While the print sheet 3 is passing between the heat roller 32 and the pressing roller 31 after toner has been transferred to the print sheet 3 in the developing unit 12, toner melts and becomes fixed onto the print sheet 3 due to heat. After the fixation is completed, the print sheet 3 is conveyed to a pair of sheet ejecting rollers 34 by the conveying rollers 33. The print sheet 3 is then ejected onto an output tray 35 by the sheet ejecting rollers 34.

The laser printer 1 recovers residual toner from the photosensitive drum 21 after the transfer of a visualized image is performed by the transfer roller 26, by a generally termed cleaner-less method. In the cleaner-less method, toner remaining on the photosensitive drum 21 after the transfer of a visualized image is first brought to face the scorotron electrical charging device 25 as the photosensitive drum 21 rotates, so that the toner is uniformly positively charged by the scorotron electrical charging device 25. As the photosensitive drum 21 further rotates, the remainder toner on the photosensitive drum 21 is brought to face the developing roller 22. Then, the toner is recovered by the developing roller 22 simultaneously with image development, due to the bias applied to the developing roller 22.

In this embodiment, the pressing force of the pressing portion 38 of the layer thickness-regulating blade 23 on the develop in roller 22 is set to a very weak force of 15–30 gf/cm. The pressing force of the pressing portion 38 on the developing roller 22 can be appropriately set by suitably adjustin the position at which the end portion of the blade body 37 is supported to the developing cartridge 36, or the curvature or the amount of bending deformation of the blade body 37, or the like.

The setting of the pressing force of the pressing portion 38 on the developing roller 22 to a very weak force of 15–30 gf/cm considerably reduces the sinking of the external additive into toner matrix particles occurring when toner is rubbed between the pressing portion 38 and the developing roller 22, and reduces the abrasion of the silicone rubber of the developing roller 22 or the pressing portion 38. Furthermore, despite such a weak pressing force, toner is sufficiently electrically charged and supported on the developing roller 22 because toner is pressed by the pressing portion 38 formed from a silicone rubber having a very good electrical charging characteristic. Therefore, image development is performed in a good manner without a development defect caused by an electrical charging defect. Furthermore, the life spans of the layer thickness-regulating blade 23 and the developing unit 12 will be extended, so that the running cost will decrease.

The roller part of the developing roller 22 is formed by an elastic body of an electrically conductive urethane or silicone rubber. The pressing portion 38 of the layer thickness-regulating blade 23 is also formed from a silicone rubber. Thus, the pressing portion 38 and the developing roller 22, which press toner therebetween, have elasticity. Therefore, the sinking of extental additive particles into toner matrix particles at the time of press between the pressing portion 38 and the developing roller 22 is further reduced, and silicone rubber abrasion is further reduced.

The toner used in this embodiment is a polymerized toner having a very good flowability, so that the friction resistance occuring when toner is pressed and rubbed between the developing roller 22 and the pressing portion 38 of the layer thickness-regulating blade 23 is reduced. That is, if the pressure or pressing force of the pressing portion 38 onto the developing roller 22 is very weak as in this embodiment, the pressure between the pressing portion 38 and the developing roller 22 may fluctuate based on changes in the friction force caused depending on various conditions, for example, variations among individual apparatuses or the like, so that stable electrical charging characteristic cannot be achieved in some cases. However, if a polymerized toner having a very good flowability is used, the fluctuations of the pressure based on changes in the friction force will considerably decrease, so that stable image development can be ensured for a long period of time.

Furthermore, in the embodiment, the surface of the roller part of the developing roller 22 is coated with a coat layer of a urethane or silicone rubber that contains fluorine, which reduces friction resistance. Thus, the developing roller 22 is designed to further reduce the friction resistance occurring when toner is pressed and rubbed between the developing roller 22 and the pressing portion 38 of the layer thickness-regulating blade 23. Therefore, the fluctuations of the pressure or pressing force based on changes in the friction force are further stabilized, so that further stable development will be performed for a long time.

Further, in the embodiment, the surface roughness of the developing roller 22 is less than the mean particle size of the toner. If the surface roughness of the developing roller 22 is greater than the mean particle size of toner, toner may be stuck in irregularities on the surface of the developing roller 22 so that pressing force from the layer thickness-regulating blade 23 will not reach the toner stuck in irregularities in some cases. However, the embodiment will not cause such an undesired event. In the embodiment, the toner on the surface of the developing roller 22 is pressed by a constant pressure or pressing force, and is therefore always electrically charged consistently, so that stable development is ensured for a long time.

As is apparent from the above description, the laser printer 1 of the embodiment is able to constantly form an image with stable quality without allowing an image formation defect, for example, a fog or the like, which may result from an electrical charging defect.

EXPERIMENTAL EXAMPLES

Experimental examples of the invention will be described below. The invention is not restricted by the experimental examples.

1) Image Forming Apparatus

A laser printer having a construction as described below was used as an image forming apparatus.

The basic construction of the laser printer used in the examples is substantially the same as that of the laser printer 1 described above.

Developing Roller

A developing roller having a fluorine-based surface coat layer on an electrically conductive urethane rubber roller part was used.

Supplying roller

A supplying roller formed from an electrically conductive urethane foam rubber was used.

Layer Thickness-Regulating Blade

A layer thickness-regulating blade formed by forming a semicircular cylinder-shaped silicone rubber member of 3.5 nm in diameter on a stainless steel plate spring was used. The layer thickness-regulating blade was set so as to provide pressing forces shown in Table 1.

Toner

A toner of a non-magnetic single-component made of spherical particles of a styrene-acryl copolymer obtained through suspension polymerization, with nigrosine as a charge control agent, carbon as a coloring agent, wax, and the like, and with external additives of silica of a BET specific surface area of 200 $m^2/g$ and silica of a specific surface area of 50 $m^2/g$, was used.

The silica particles had been subjected to a known surface treatment with silicone oil, a silane coupling agent, or the like.

Print Conditions

At a print speed of 20 ppm (10 cm/sec. in terms of the circumferential velocity of the photosensitive drum), entire sheet area printing of a print area rate of 4% was performed intermittently at a rate of 2 sheets per minute.

2) Evaluation

Print Quality after 16,000 Sheets

After 16,000 sheets were printed under the aforementioned conditions, the printing of a zip pattern of one printed dot followed by a two-dot space was performed on the entire print area of each sheet. The quality of the printed zip pattern was evaluated. Results thereof are shown in Table 1.

Number of Printed Sheets before Wear-Out of Layer Thickness-Regulating Blade

At every 16,000 sheets printed under the aforementioned conditions, 400 g of toner was added. This printing procedure was repeated until occurrence of a print defect based on wear-out of the layer thickness-regulating blade. The number of sheets printed before occurrence of the defect was counted. Results are shown in Table 1. Occurrence of a print defect based on occurrence of wear-out of the layer thickness-regulating blade was detected by using occurrence of a longitudinal stripe in printing as an indication. After a longitudinal stripe occurred, the layer thickness-regulating blade was replaced, and the quality of printing provided by a new layer thickness-regulating blade was checked to see whether the old layer thickness-regulating blade had actually worn out.

In the above-described test, occurrence of a print fog during an initial period of printing was also checked. Results of the check are shown in Table 1.

TABLE 1

| Pressing force (gf/cm) | Number of sheets before blade wear-out | Print quality after 16000 sheets | Fog during initial print |
|---|---|---|---|
| 10 | 38000 | Δ | occurred |
| 15 | 36000 | ○ | not occurred |
| 20 | 35000 | ○ | not occurred |
| 30 | 33000 | ○ | not occurred |
| 40 | 31000 | Δ | not occurred |
| 50 | 29000 | Δ | not occurred |
| 60 | 28000 | Δ | not occurred |
| 70 | 26000 | x | not occurred |

○: Not changed from initial print
Δ: Deteriorated in print quality
x: Deteriorated to unusable state As shown in Table 1, the number of sheets printed before occurrence of wear-out of the layer thickness-regulating blade deceased with increases in the pressing force. The results strongly indicate that the abrasion of silicone rubber can be reduced by reducing the pressing force.

The print quality after 16,000 sheets was good with the pressing forces of 15–30 gf/cm. With the pressing force of 10 gf/cm, electrical charging of the toner was insufficient and caused a print defect because the pressing force was excessively weak. Furthermore, with the pressing force of 10 gf/cm, print fog occurred during an initial period.

With the pressing forces of 40 gf/cm and greater, the electrical charging of toner was sufficient. However, as shown in Table 1, the strong pressing forces caused deterioration in print quality due to occurrence of the sinking of external additive particles into toner matrix particles.

With the pressing forces of 15–30 gf/cm, the life span of the layer thickness-regulating blade was extended to more than two times the conventional life span, which is about 16,000 sheets printed.

Changes in the life span of the layer thickness-regulating blade with changes in the toner construction under a fixed pressing force condition will be described.

Figure 2:
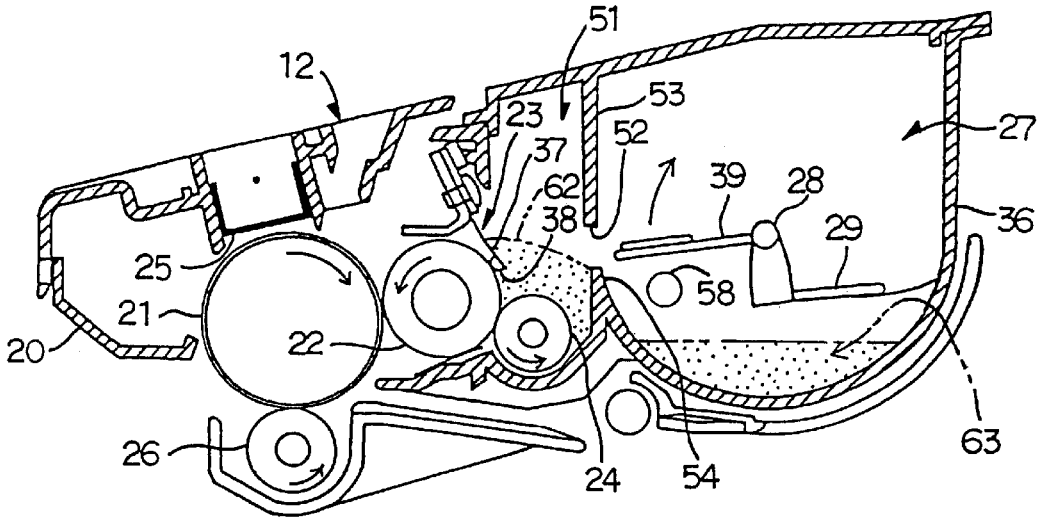
FIG. 2 is a side sectional view of a developing unit.
Figure 3:
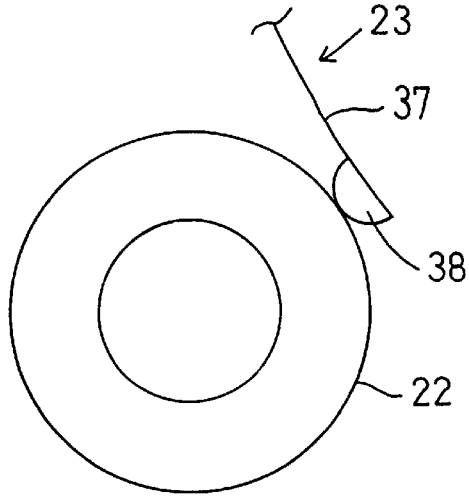
FIG. 3 illustrates a layer thickness-regulating blade pressed against a developing roller.

As shown in FIGS. 2 and 3, the layer thickness-regulating blade 23 is substantially made up of the pressing portion 38 for direct contact with toner carried on the developing roller 22, and the blade body 37 formed by a plate spring for pressing the pressing portion 38 against the developing roller 22 with a predetermined pressing force. In the examples, the blade body 37 was formed from an SUS plate having a thickness of 0.1 mm, and the pressing portion 38 was formed by a silicone rubber member having a sectional shape of a semicircle of 3.5 mm in diameter. The developing cartridge 36 and the photosensitive drum 21 were designed so as to be replaceable separately.

The laser printer 1 constructed as described above is able to uniformly restrict the layer thickness of toner conveyed on the developing roller 22 to the surface of the photosensitive drum 21, due to the pressing portion 38 contacting the toner on the developing roller 22. Toner is friction-electrically charged due to the rubbing thereof between the pressing portion 38 and the developing roller 22, and electrically charged toner deposits on an electrostatic latent image formed on the photosensitive drum 21, due to electrostatic attraction. Therefore, it becomes possible to deposit toner onto an electrostatic latent image in a uniform layer thickness and to transfer the toner to a print sheet so as to form a sharp image on the sheet.

The silicone rubber forming the pressing portion 38 has a good electrical charging characteristic with respect to the toner, and also has an appropriate softness, so that the silicone rubber can prevent the external additive particles from being sunk into toner matrix particles. Therefore, it becomes possible to uniformly electrically charge the toner in a good manner and to secure a good flowability of toner. Therefore, the laser printer 1 is able to form a very good image without causing print fog or roughness.

The silicone rubber forming the pressing portion 38 is apt to abrade. Therefore, the embodiment employs a styrene-acryl polymerized toner. Polymerized toners have particle shapes very close to a sphere, and are considered to have very good flowability, in comparison with pulverized toners. Among polymerized toners, a suspension-polymerized toner produced through suspension polymerization, such as the styrene-acryl polymerized toner, particularly has a particle shape that is extremely close to a sphere, and is considered to have an extremely good flowability. Therefore, the embodiment, employing the styrene-acryl polymerized toner, favorably reduces the abrasion of the silicone rubber forming the pressing portion 38, and effectively reduces the running cost of the laser printer 1.

Figure 4:
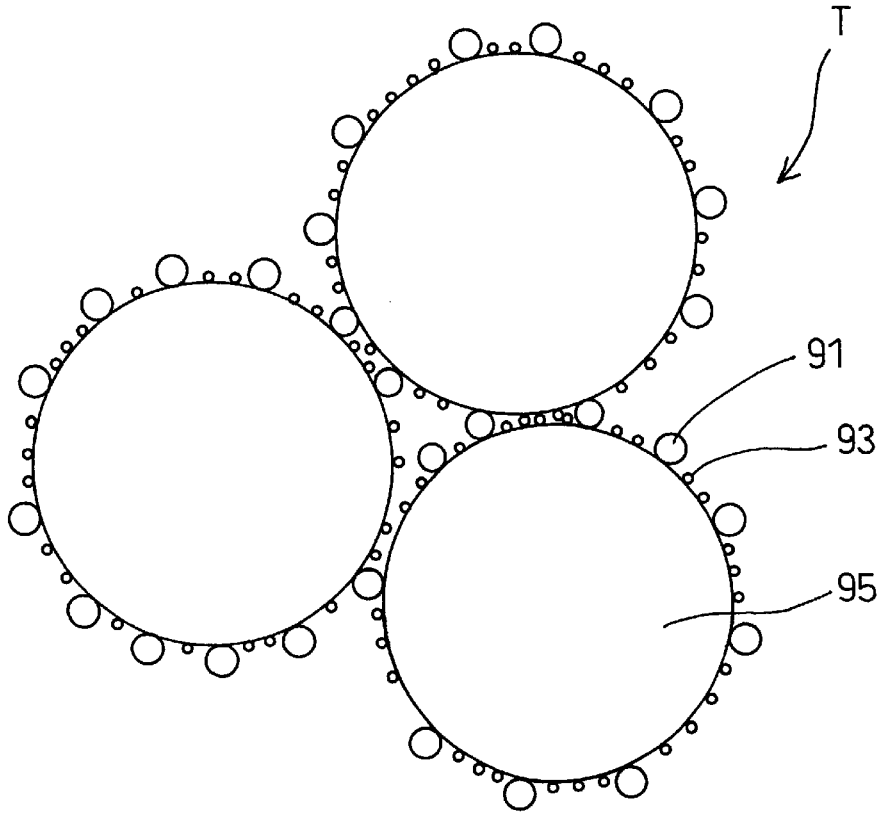
FIG. 4 illustrates large and small external additive particles adhered to developer particles.

Furthermore, in the embodiment, the toner contains two kinds of external additives having different particle sizes. As a larger-particle-size external additive, an external additive having a relatively large BET specific surface area that is less than about 100 $m^2/g$ (preferably, less than about 50 $m^2/g$) based on nitrogen adsorption is added to the toner T. Advantages of adding two kinds external additives having different particle sizes will be described below. As shown in FIG. 4, larger external additive particles 91 function as spacers, that is, larger external additive particles 91 deposited on a toner matrix particle 95 substantially prevent smaller external additive particles 93 deposited on the same toner matrix particle 95 from directly contacting another toner matrix particle 95, and therefore substantially prevents the smaller external additive particles 93 from being sunk into the toner matrix particle 95.

If an external additive having a BET specific surface area less than about 100 $m^2/g$ is used as a larger-particle external additive, prevention of the sinking of smaller external additive particles 93 is further favorably achieved, thereby securing good flowability of the toner in a more favorable manner.

According to the conventional art, it has been difficult to use such a large-particle external additive because the use of a large-particle external additive accelerates the abrasion of the silicone rubber. In the embodiment, however, since a styrene-acryl polymerized toner is adopted to reduce the abrasion of the silicone rubber as mentioned above, it becomes possible to use a large-particle external additive. Furthermore, if the pressing portion 38 of the layer thickness-regulating blade 23 wears out, the layer thickness-regulating blade 23 with the worn-out pressing portion 38 can easily be replaced, simultaneously with an operation of replacing the developing cartridge 36. Therefore, the laser printer 1 is able to form very good images.

Table 2 shows a print quality achieved in a comparative example in which a pulverized toner was used, and print qualities achieved in examples with various external additive particle sizes. The data shown in Table 2 were obtained in experiments in each of which the mean size of toner matrix particles was 9 $\mu$m and external additives of silica were used. In the experiments, an entire sheet area pattern having a print area of 4% was printed intermittently at a rate of one sheet per 30 seconds. In each experiment, 300 g of the toner was supplied at an initial timing, and 250 g of the toner was added every time 10,000 sheets were printed. The toner consumption was about 50 g per 1,000 sheets.

TABLE 2

| Toner (9 $\mu$m in mean particle size) | External additives: silica | Number of sheets before rubber wear-out | Print quality after 10000 sheets (before toner addition) |
|---|---|---|---|
| Polyester pulverized | BET200: 0.6 wt. %<br>BET50: 1.0 wt. % | 2000 | |
| Styrene-acryl polymerized | BET200: 0.6 wt. %<br>BET150: 1.0 wt. % | 34000 | Δ: rough print, exposure defect |
| Styrene-acryl polymerized | BET200: 0.6 wt. %<br>BET100: 1.0 wt. % | 26000 | Δ: rough print |
| Styrene-acryl polymerized | BET200: 0.6 wt. %<br>BET50: 1.0 wt. % | 15000 | ○ |

As is apparent from Table 2, when the pulverized toner was used, the silicone rubber forming the pressing portion 38 wore out and caused a print defect at the time of 2,000 sheets printed. In contrast, the polymerized toners all allowed more than 10,000 sheets to be printed before the silicone rubber wear-out. The amount of abrasion of the pressing portion 38 at the time of occurrence of a print defect was about 1.2 mm. Print quality was evaluated at the time of 10,000 sheets printed (before the toner was added). In the cases where a larger-particle external additive having a BET specific surface area of 100 $m^2/g$ or greater was used, the sinking of external additive particles occurred, thereby causing a rough print. In particular, when a larger-particle external additive having a BET specific surface area of 150 $m^2/g$ was used, the transfer-to-sheet characteristic of the toner deteriorated, so that toner not transferred to a sheet but left on the scorotron electrical charging device 25, that is, generally termed transfer residual toner, caused an exposure defect (i.e., a phenomenon in which a transfer residual toner mass blocks exposure laser light L and the portion of the surface of the scorotron electrical charging device 25 underneath the toner mass causes a blank in a solid black printed area).

The aforementioned experiment results indicate that it is desirable to use a styrene-acryl polymerized toner with an external additive of silica having a BET specific surface area of 200 $m^2/g$ and an external additive of silica having a BET specific surface area of 50 $m^2/g$ and replace the toner with new toner together with the layer thickness-regulating blade 23 (pressing portion 38) at the time of 10,000 sheets printed. If used in that manner, the laser printer 1 is able to maintain very good print image quality. Although the pressing portion 38 remained usable up to at least 15,000 sheets in the case where a combination of a polymerized toner and external additives as mentioned above was adopted as can be seen from Table 2, it is desirable to replace the pressing portion 38 at the time of about 7,000 sheets printed in actual use, considering various conditions of use.

Therefore, the embodiment is designed so that an amount of toner that allows the printing of 7,000 sheets can be contained in the toner box 27 of the developing cartridge 36, and the toner can be replaced together with the supplying roller 24, the developing roller 22 and the layer thickness-regulating blade 23. This replacement operation can be performed separately from the replacement of the photosensitive drum 21. Therefore, when the pressing portion 38 of the layer thickness-regulating blade 23 wears out, the pressing portion 38 (or the layer thickness-regulating blade 23) and the toner can be together replaced with new ones. At that time, the photosensitive drum 21 is still usable, and does not need to be replaced. Thus, the embodiment facilitates replacement of the pressing portion 38 (or the layer thickness-regulating blade 23) and further favorably reduces the running cost of the laser printer 1.

Although the embodiment uses a positively electrically charged toner of a single non-magnetic component, a negatively electrically charged toner may instead be used. In that case, too, the silicone rubber will favorably and uniformly electrically charge the developer, so that substantially the same advantages as achieved by the foregoing embodiment can also be achieved.

Furthermore, although the embodiment employs a suspension-polymerized toner, the invention is also applicable to a case where a polymerized toner other than a suspension-polymerized toner, for example, a polymerized toner produced through emulsion polymerization, is used. Even in the case where a kind of toner different from that used in the foregoing embodiment is used, the toner will have relatively good flowability, thereby achieving advantages that may be of less extent than but are similar to those achieved by the suspension-polymerized toner. Still further, if the developing cartridge 36 is designed to be replaceable as described above, an extended life span of the photosensitive drum 21 can be achieved to reduce the running cost to some extent even with a pulverized toner used.

In a construction where residual toner is recovered from the photosensitive drum 21 into the developing chamber 51 by the cleaner-less method as described above, deteriorated toner having a reduced flowability or a reduced electrical charging characteristic as a result of the rubbing between the pressing portion 38 and the developing roller 22 followed by deposit on the photosensitive drum 21 returns into the developing chamber 51.

Therefore, as an image forming operation is repeated in the developing chamber 51, the proportion of deteriorated toner steadily increases with toner consumption. Therefore, in some cases, degradation of toner flowability causes a filming on the photosensitive drum 21, a rough print image, or the like, or degradation of electrical charging characteristic causes excessively high image density and therefore form hard-to-distinguish printed characters (crushed characters) or the like, or produces oppositely electrically charged toner and therefore causes fogging.

Therefore, the embodiment employs a toner-empty sensor 55 that detects a limit of toner consumption, that is, a toner empty state, when toner still remains in the developing cartridge 36. The toner-empty sensor 55 is designed to detect the toner empty state when toner remains in the toner box 27 and the amount of toner remaining in the toner box 27 is equal to or greater than the amount of toner remaining in the developing chamber 51.

Figure 5:
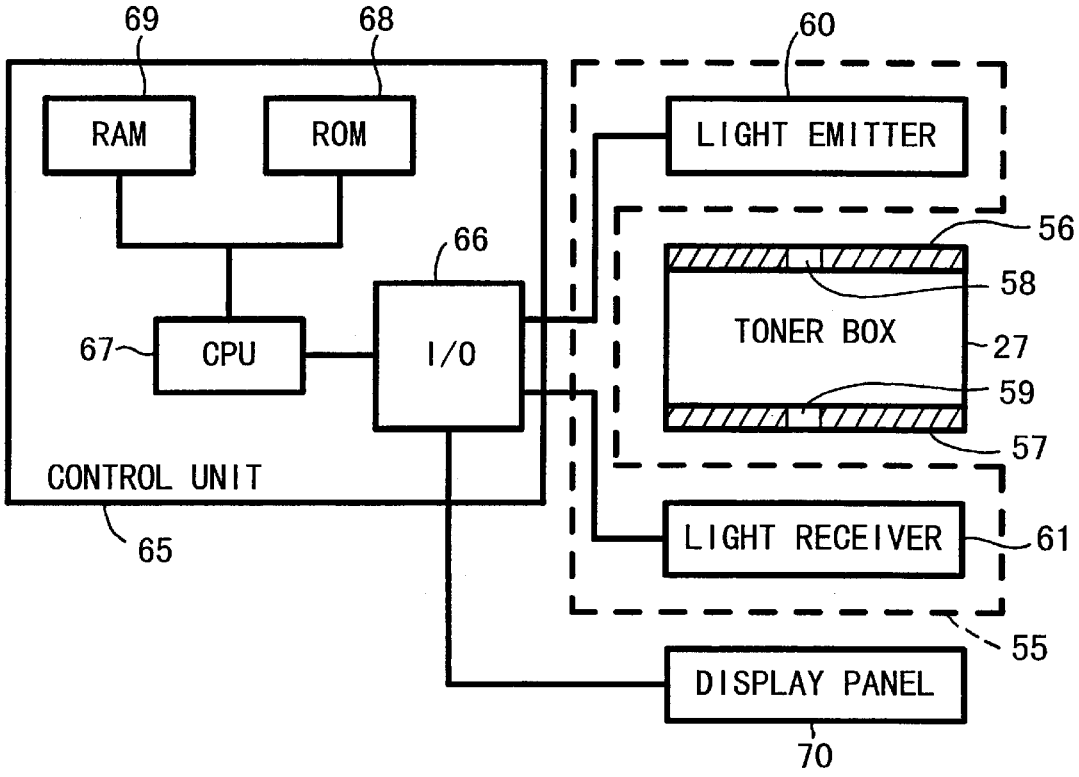
FIG. 5 is a schematic illustration of a toner empty sensor and a control system thereof.

The toner-empty sensor 55 is formed by a photosensor that has a light emitter 60 equipped with a light-emitting element and a light receiver 61 equipped with a light-receiving element. As shown in FIGS. 2 and 5, the light emitter 60 and the light receiver 61 are disposed outside the toner box 27, more specifically, at opposite side walls 56, 57 of the toner box 27 having light-transmitting windows 58, 59, respectively, in such a manner that the light emitter 60 and the light receiver 61 face the light-transmitting windows 58, 59, respectively.

The light-transmitting windows 58, 59 in the opposite side walls 56, 57 of the toner box 27 are formed so that a cleaner 39 provided in the toner box 27 wipes out the window surfaces as it turns. The light-transmitting windows 58, 59 are formed at positions at which a portion of the toner box 27 having a capacity equal to or greater than the volume of toner containable in the developing chamber 51 is defined. The positions of the light-transmitting windows 58, 59 are suitably determined in accordance with the capacity of the developing chamber 51 and the capacity of the toner box 27. In FIG. 2, the volume of toner containable in the developing chamber 51 is indicated by an imaginary line 62, and a portion of the toner box 27 having a capacity substantially equal to the volume of toner containable in the developing chamber 51 is indicated by an imaginary line 63.

The light emitter 60 and the light receiver 61 are supported by a frame (not shown) of the body casing 2 in such a manner that the light emitter 60 and the light receiver 61 face the light-transmitting windows 58, 59 formed at positioned as described above, respectively. Therefore, the toner-empty sensor 55 is able to detect the toner empty state when the amount of toner remaining in the toner box 27 is equal to or greater than the amount of toner remaining in the developing chamber 51.

As is apparent from the illustration of a control system of the toner-empty sensor 55 in FIG. 5, while the amount of toner remaining in the toner box 27 is relatively large, the light receiver 61 does not receive light emitted from the light emitter 60 because light from the light emitter 60 is blocked by toner in the toner box 27. In that case, therefore, the light receiver 61 does not produce an output based on light reception. When the amount of toner in the toner box 27 becomes relatively small, light from the light emitter 60 reaches the light receiver 61 every time toner is agitated in the toner box 27 by the agitator 29. In that case, therefore, the light receiver 61 produces an output based on the amount of light received. For example, the light receiver 61 may be designed so that the output of the light receiver 61 is produced in the form of a pulse signal and the pulse width is increased as the amount of toner in the toner box 27 decreases. The output of the light receiver 61 is monitored by a CPU 67 via an input/output port 66 of a control unit 65 shown in FIG. 5. The CPU 67 is connected to a ROM 68 storing programs and a RAM 69 used for storing data and the like. Following the programs stored in the ROM 68, the CPU 67 measures the width of the pulse signal received from the light receiver 61, and stores it into the RAM 69, and determines whether the stored pulse width has exceeded a predetermined threshold. When it is determined that the pulse width has exceeded the predetermined threshold, the CPU 67 outputs the detection of the toner empty state via the input/output port 66, so that a display panel 70 displays an indication to advise a user that the developing cartridge 36 be replaced, that is, toner be added.

Provision of the toner-empty sensor 55 as described above makes it possible to detect the toner empty state while toner remains in the developing cartridge 36 although the proportion of deteriorated toner to the entire amount of toner present in the developing cartridge 36 increases as the image forming operation is repeated. Therefore, it becomes possible to replace deteriorated toner with fresh toner at an early timing at which image development is performed by using toner having a low proportion of deteriorated toner, in comparison with a construction that lets toner be consumed until toner completely runs out in the developing chamber 51 and the toner box 27 without producing any indication before the exhaustion.

That is, the proportion of deteriorated toner to the entire amount of toner remaining in the developing chamber 51 is very high immediately before toner in the developing chamber 51 and the toner box 27 is completely consumed. If such toner is used for image development, various problems occur, for example, a filming on the photosensitive drum 21, and the like. However, if deteriorated toner is replaced with fresh toner when a certain amount of toner remains in the developing cartridge 36, image development through the use of toner having a high proportion of deteriorated toner immediately before complete consumption of toner is avoided. Therefore, image development can be constantly and stably performed without allowing occurrence of various problems as mentioned above, and the life span of the laser printer 1 can be increased.

It is to be noted that the developing cartridge 36 and the photosensitive drum 21 are separable in the embodiment. Therefore, it is possible to replace the developing cartridge 36 alone when a certain amount of toner remains in the developing cartridge 36, that is, when the proportion of deteriorated toner is still low, based on the detection by the toner-empty sensor 55. Hence, it is possible to continue to use the photosensitive drum 21 without causing significant problems on the photosensitive drum 21 due to deteriorated toner. Thus, it becomes possible to extend the life span of the photosensitive drum 21, and considerably reduce the running cost while reducing the amount of waste parts and the like.

Furthermore, toner is allowed to move in both directions between the toner box 27 and the developing chamber 51 via the opening 52 formed therebetween, that is, toner present in the toner box 27 is allowed to move into the developing chamber 51, and toner present in the developing chamber 51 is allowed to move into the toner box 27. In a condition where toner is allowed to move in that manner, the toner-empty sensor 55 detects the toner empty state while toner remains in the toner box 27.

That is, since toner present in toner box 27 and toner present in developing chamber 51 are allowed to move between the toner box 27 and the developing chamber 51, it is possible not only for unused (fresh) toner to move from the toner box 27 into the developing chamber 51 but also for deteriorated toner to move from the developing chamber 51 into the toner box 27. Therefore, deteriorated toner is prevented from residing in the developing chamber 51, and is also effectively prevented from being repeatedly rubbed between the pressing portion 38 of the layer thickness-regulating blade 23 and the developing roller 22 and is therefore prevented from rapidly deteriorating. Furthermore, it also becomes possible to curb an increase in the proportion of deteriorated toner to the entire amount of toner present in the developing chamber 51.

Even though toner present in the toner box 27 and toner present in the developing chamber 51 are allowed to move between the toner box 27 and the developing chamber 51, toner resides only in the developing chamber 51 and rapidly deteriorates as toner is consumed, if the amount of toner present in the developing chamber 51 becomes insufficient to allow toner to return into the toner box 27, that is, if toner runs out in the toner box 27. Therefore, the toner-empty sensor 55 detects the toner empty state while toner remains in the toner box 27, that is, while it is possible for toner present in the toner box 27 and toner present in the developing chamber 51 to move between the toner box 27 and the developing chamber 51. This detecting manner of the toner-empty sensor 55 prevents toner from residing only in the developing chamber 51, and therefore makes it possible to constantly form an image of consistent quality, and extends the life span of the laser printer 1. Furthermore, since a polymerized toner having very good flowability is used, circulating flow of toner occurs as the developing roller 22 and the supplying roller 24 rotate. As a result, it becomes possible for toner present in the toner box 27 and toner present in the developing chamber 51 to move more smoothly between the toner box 27 and the developing chamber 51, and it also becomes possible to more effectively prevent toner from residing only in the developing chamber 51.

Furthermore, the toner-empty sensor 55 is provided at the toner box 27, and the light emitter 60 and the light receiver 61 are disposed at such positions that a detectable volume of toner contained in the toner box 27 is equal to or greater than the volume of toner that is allowed to exist in the developing chamber 51. Therefore, the toner-empty sensor 55 detects the toner empty state when the amount of toner present in the toner box 27 is equal to or greater than the amount of toner present in the developing chamber 51. Therefore, it becomes possible to replace toner with fresh toner while image development is performed by using toner having a low proportion of deteriorated toner. As a result, it becomes possible to stably form an image, and it also becomes possible to extend the life span of the laser printer 1.

Still further, the light emitter 60 and the light receiver 61 are disposed at opposite sides of the toner box 27, and are disposed at positions at which a portion of the toner box 27 having a capacity equal to or greater than the volume of toner that is allowed to exist in the developing chamber 51 is defined. This simple arrangement reduces costs.

In the embodiment, the developing roller 22 and the photosensitive drum 21 are disposed, facing and contacting each other. Therefore, filming on the photosensitive drum 21 is likely to be caused by deteriorated toner. However, detection by the toner-empty sensor 55 makes it possible to replace only the developing cartridge 36 with a new one while image development is performed by using toner having a low proportion of deteriorated toner. Therefore, it becomes possible to effectively prevent occurrence of filming and extend the life span of the photosensitive drum 21.

Although in the embodiment, the light emitter 60 and the light receiver 61 of the toner-empty sensor 55 are disposed at positions relative to the toner box 27 where a portion of the toner box 27 having a capacity equal to or greater than the volume of toner containable in the developing chamber 51 is defined, the light emitter 60 and the light receiver 61 may be disposed at any suitable positions as long as the positions allow the toner-empty sensor 55 to detect the toner empty state while toner exists even in a very small amount in the developing cartridge 36. For example, the light emitter 60 and the light receiver 61 may be disposed at the developing chamber 51. Even in the case where the light emitter 60 and the light receiver 61 are disposed at the toner box 27, the positions thereof are not limited to positions as described above.

Although in the embodiment, the amount of toner is detected by the photosensor substantially made up of the light emitter 60 and the light receiver 61, it is also possible to detect the rotation resistance on the agitator 29 instead. It is also possible to employ a method in which electrodes are provided at such positions that they can contact toner, and electric resistance is detected. Although in the embodiment, upon detection of the toner empty state, the display panel 70 displays an indication to advise that the developing cartridge 36 be replaced, it is also possible to stop the laser printer 1 after the toner empty state is detected. It is also possible to transmit a detection signal indicating detection of the toner empty state to a personal computer connected to the laser printer 1 and to perform a suitable operation for, for example, display, stop, or the like, in the personal computer.

EXPERIMENTAL EXAMPLES

The invention will be further described specifically with reference to experimental examples.

1) Image Forming Apparatus

A laser printer having a construction as described below was used as an image forming apparatus.

The basic construction of the laser printer used in the examples is substantially the same as that of the laser printer 1 described above.

Developing Cartridge

A developing cartridge replaceable separately from a drum cartridge was used.

Developing Roller

A developing roller having a fluorine-based surface coat layer formed on an electrically conductive urethane rubber roller part was used.

Supplying roller

A supplying roller formed from an electrically conductive urethane foam rubber was used.

Layer Thickness-Regulating Blade

A layer thickness-regulating blade having a semicircular cylinder-shaped silicone rubber member of 3.5 mm in diameter formed together with a plate spring was used.

Toner

A toner of a single non-magnetic component made of spherical particles of a styrene-acryl copolymer obtained through suspension polymerization, with nigrosine as a charge control agent, carbon as a coloring agent, wax, and the like, and with external additives of silica of a BET specific surface area of 200 $m^2/g$ and silica of a specific surface area of 50 $m^2/g$, was used.

The silica particles had been subjected to a known surface treatment with silicone oil, a silane coupling agent, or the like.

Print Conditions

At a print speed of 20 ppm (10 cm/sec. in terms of the circumferential velocity of the photosensitive drum), entire sheet area printing of a print area rate of 4% was performed intermittently at a rate of 2 sheets per minute.

2) Evaluation

Before evaluation, it was checked that under the aforementioned print conditions, the toner consumption per 1,000 sheets was 25 g, and the toner remaining in the toner cartridge at the time of exhaustion of toner in the toner box was about 30

After 125 g of toner (corresponding to the printing of 5,000 sheets) and an amount of toner corresponding to the amount of toner that was desired to remain (shown in Table 3) were put into the developing cartridge, an endurance test of printing of 5,000 sheets was performed under the aforementioned print conditions. After 5,000 sheets were printed, only the developing cartridge was replaced (the photosensitive drum remained). Then, the printing of a zip pattern of one printed dot followed by a two-dot space was performed on the entire print area of each sheet. Evaluation regarding whether a filming occurred on the photosensitive drum was performed. In a case where no filming occurred on the photosensitive drum, the endurance print test was performed for another 5,000 sheets. The endurance test was repeated until a filming occurred on the photosensitive drum. Results are shown in Table 3. Whether a filming occurred on the photosensitive drum was determined on the basis of whether density inconsistency in a longitudinal stripe manner occurred in the zip pattern.

TABLE 3

| Amount of remainder toner (g) | Total number of sheets printed before the filming on photosensitive drum |
|---|---|
| 0 | 5000 |
| 10 | 10000 |
| 30 | 15000 |
| 60 | 40000 |

Table 3 indicates that it is possible to extend the life span of the photosensitive drum by replacing the developing cartridge while some toner remains therein. That is, in the cases where toner was completely consumed (no remainder toner), the life span of the photosensitive drum became no longer than the life span of the developing cartridge and, therefore, containing the photosensitive drum in a cartridge separate from the developing cartridge was useless. If the developing cartridge was replaced while some toner remained therein, the life span of the photosensitive drum became longer with increases in the amount of remainder toner. Particularly in the case where the developing cartridge was replaced when the amount of remainder toner was 60 g, the filming did not occur until 40,000 sheets were printed. Thus, the results indicate that the life span of the photosensitive drum can be considerably extended by replacing the toner cartridge while the amount of toner remaining in the toner box is equal to or greater than the amount of toner remaining in the developing chamber.

The aforementioned examples used a toner produced by mixing nigrosine as a charge control agent with a styrene-acryl polymerized toner and adding silica thereto. A toner containing a charge control resin as a charge control agent will be described below. Typical charge control resins are colorless and transparent, and therefore suitable for full-color development.

The charge control resin used in the toner can be obtained by copolymerizing an ionic monomer having an ionic functional group, such as ammonium salt or the like, for example, N,N-diethyl-N-methyl-2-(methacryloyloxy) etylammonium P-toluenesulfonate, and a monomer copolymerizable with an ionic monomer as mentioned above, for example, a styrene-based monomer, such as styrene or the like, or an acryl-based monomer such as acrylic acid, alkyl(C1–C4) acrylate, alkyl(C1–C4) methacrylate or the like. If such a charge control resin is used, it becomes possible to arbitrarily set an inter-molecular distance between ionic finction groups adjacent to each other by selecting a suitable proportion of each monomer. If the charge control agent is a single compound having an ionic function group, such as quaternary ammonium salt or the like, there is a danger that due to the immediate adjacency of the ionic function groups, the electric resistance decreases and the electrical charging characteristic deteriorates as the amount of the compound added increases. However, the use of the charge control resin prevents the electric resistance from decreasing with increases in the amount of the charge control agent, and favorably improves the electrical charging characteristic. In particular, a quaternary ammonium salt-containing styrene-acryl copolymer obtained by copolymerizing monomers as mentioned above as examples is excellent in dispersibility and electrical charging stability.

In the embodiment, the pressing portion 38 of the layer thickness-regulating blade 23 is formed from a silicone rubber that has a particularly good electrical charging characteristic with respect to toner. Therefore, even if the toner contains a charge control resin as a charge control agent, the toner will be sufficiently electrically charged due to friction between the pressing portion 38 and the developing roller 22. Hence, it becomes possible to favorably develop an image without allowing a development defect due to a toner electrical charging defect. Thus, a high-quality image can be formed.

Furthermore, in the embodiment, a polymerized toner having good flowability is used and fluorine is contained in a surface portion of the developing roller 22, so that the toner can be sufficiently electrically charged without a need to strongly press the pressing portion 38 against the developing roller 22. Therefore, although the pressing portion 38 is formed from a silicone rubber, which is apt to abrade, the abrasion of the silicone rubber is remarkably reduced and the life span of the pressing portion 38 considerably increases.

Furthermore, in the embodiment, a contact portion of the pressing portion 38 that contacts the developing roller 22 and toner has a pad shape without an angled edge or the like, so that the area of contact with toner is relatively large. Therefore, the electrical charging of toner is further improved. The abrasion of the contact portion due to contact with toner is reduced. Thus, the pressing portion 38 is designed so that the abrasion of the pressing portion 38 is further reduced.

Figure 6:
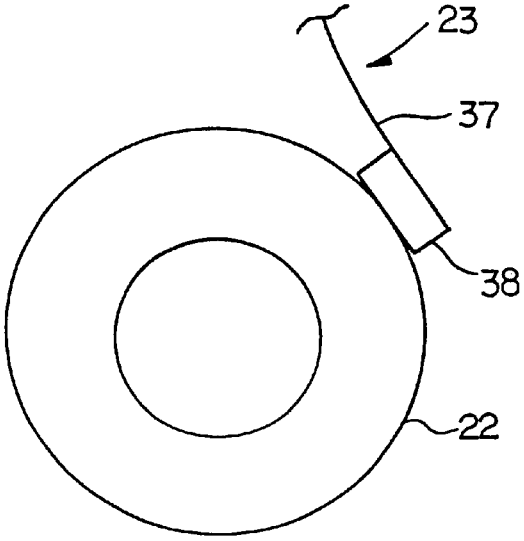
FIG. 6 shows another embodiment of the layer thickness-regulating blade.
Figure 7:
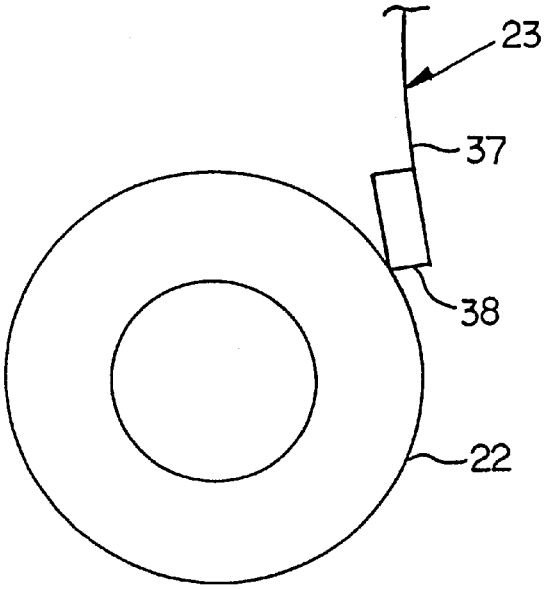
FIG. 7 shows a comparative example of a layer thickness-regulating blade.

The contact portion of the pressing portion 38 that contacts the developing roller 22 may have any shape, for example, a flat shape as shown in FIG. 6, as long as the contact portion does not include an angled portion. However, if the contact portion includes an angled portion as shown in FIG. 1, that is, if an angled portion of the pressing portion 38 contacts the developing roller 22 and toner although the configuration of the pressing portion 38 shown in FIG. 7 is the same as that shown in FIG. 6, the advantages mentioned above cannot be achieved.

Figure 8:
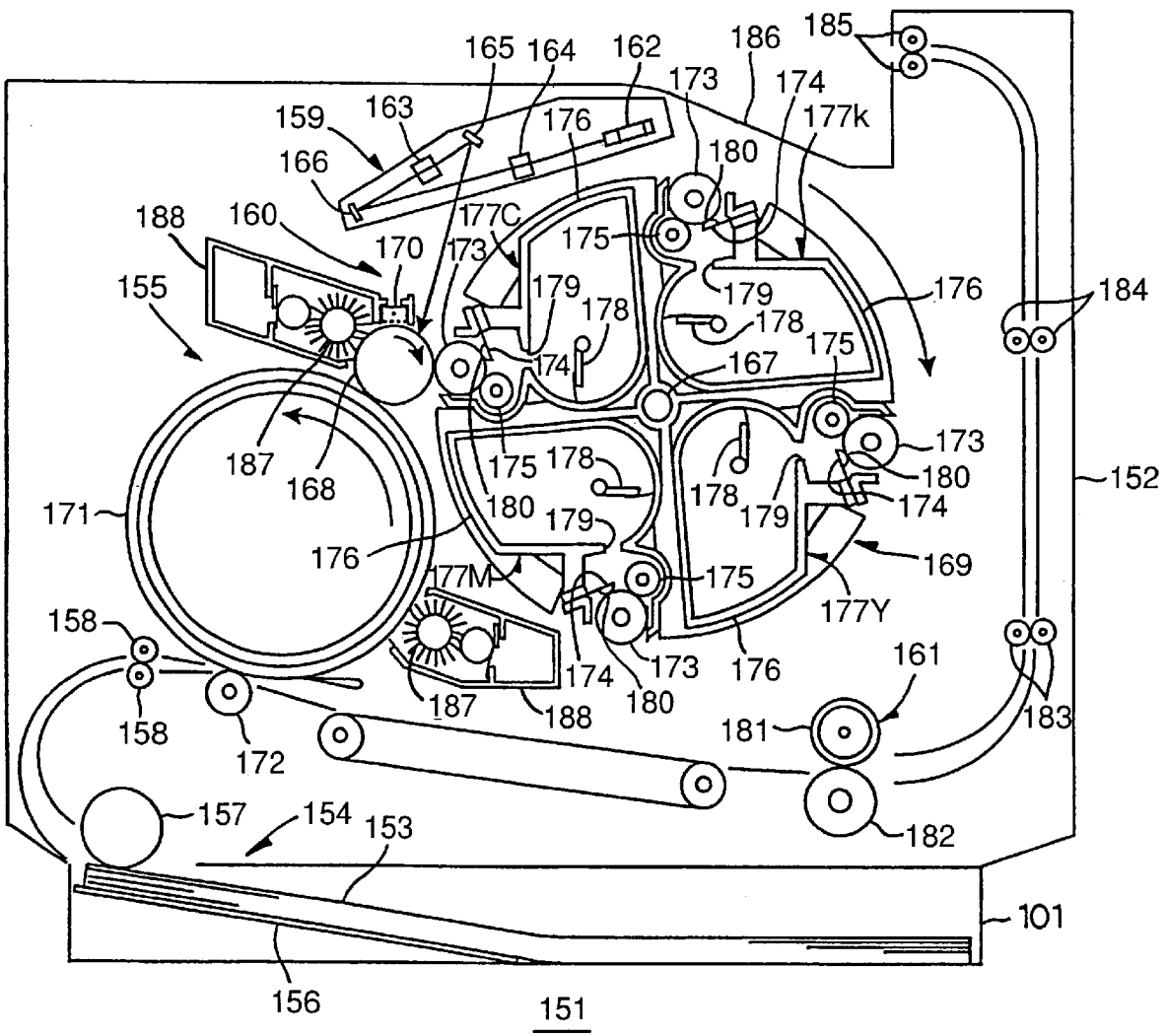
FIG. 8 is a side sectional view of a laser printer.

FIG. 8 is a sectional view of portions of an embodiment of a color laser printer.

Referring to FIG. 8, a laser color printer 151 has, in a body casing 152, a feeder unit 154 for supplying print sheets 153, and an image forming unit 155 for forming a predetermined image on a print sheet 153 supplied thereto.

The feeder unit 154 is provided in a bottom portion within the body casing 152. The feeder unit 154 has a sheet feed tray 101, a sheet pressing plate 156 provided in the sheet feed tray 101, a sheet feeder roller 157, and register rollers 158. A stack of print sheets 153 placed on the sheet pressing plate 156 is pressed against the sheet feeder roller 157 by an urging force from a spring (not shown). The uppermost print sheet 153 in the stack is fed in toward the register rollers 158 by rotating the sheet feeder roller 157. After being registered by the register rollers 158 in a predetermined manner, the print sheet 153 is conveyed to the image forming unit 155.

The image forming unit 155 includes a scanning unit 159, a developing unit 160, and a fixing unit 161.

The scanning unit 159 is provided in an upper portion of an internal space of the body casing 152. The scanning unit 159 has a laser emitting portion (not shown), a rotatable polygonal mirror 162, lenses 163, 164, and reflecting mirrors 165, 166. A laser beam that is emitted from the laser emitting portion based on predetermined image data sequentially passes through or is reflected by the optical elements, that is, the polygonal mirror 162, the lens 164, the reflecting mirror 166, the lens 163, and the reflecting mirror 165 in that order as indicated by an arrow. The laser beam is thus directed to and high-speed scanned over a photosensitive drum 168 of the developing unit 160 for irradiation of the surface of the photosensitive drum 168.

The developing unit 160 is disposed below the scanning unit 159. The developing unit 160 includes the photosensitive drum 168, a rotatable developing unit 169, a scorotron electrical charging device 170, an intermediate transfer drum 171, and a transfer roller 172. The rotatable developing unit 169 is provided in the body casing 152, and has a circular tube shape, and is rotatable about a drive shaft 167 in a direction indicated by an arrow (clockwise). Four developing cartridges 177, that is, a cyan developing cartridge 177C, a magenta developing cartridge 177M, a yellow developing cartridge 177Y, and a black developing cartridge 177K, are detachably attached to the rotatable developing unit 169. Each developing cartridge 177 is provided with a developing roller 173, a layer thickness-regulating blade 174, a supplying roller 175, and a toner box 176.

Cyan, magenta, yellow and black positively electrically charged non-magnetic single-component toners are contained in the corresponding toner boxes 176 of the developing cartridges 177. Each toner is a polymerized toner as described above, and contains a charge control resin as described above. Since the charge control resin is colorless and transparent, the charge control resin can be used in the color toners containing corresponding coloring agents.

The toner in each toner box 176 is agitated by an agitator 178, and is discharged via a toner supply opening 179 that is formed in a side portion of the toner box 176.

In each developing cartridge 177, the supplying roller 175 and the developing roller 173 are disposed at positions sideways from the toner supply opening 179, as in the construction described above. The layer thickness-regulating blade 174 is disposed near the developing roller 173. Each layer thickness-regulating blade 174 has a silicone rubber-made pressing portion 180 that has a semicircular sectional shape.

After being discharged from the toner supply opening 179, toner is supplied to the developing roller 173 by rotation of the supplying roller 175. Toner is positively electrically charged due to friction between the supplying roller 175 and the developing roller 173. After being supplied onto the developing roller 173, toner enters a gap between the developing roller 173 and the pressing portion 180 of the layer thickness-regulating blade 174 as the developing roller 173 rotates. Between the pressing portion 180 and the developing roller 173, toner is further sufficiently electrically charged due to friction, and is formed into a thin layer having a predetermined thickness and becomes supported on the developing roller 173.

The photosensitive drum 168 is formed from a positively electrically charged material, and is disposed rotatably in a direction indicated by an arrow (clockwise). After being uniformly positively electrically charged by the positively charging scorotron electrical charging device 170 disposed above the photosensitive drum 168, the photosensitive drum 168 is exposed to a laser beam L from the scanning unit 159 so that an electrostatic latent image based on predetermined image data is formed on the photosensitive drum 168.

When the developing roller 173 of a developing cartridge 177 reaches such a position that the developing roller 173 of the cartridge 177 faces the photosensitive drum 168 as the rotatable developing unit 169 rotates, the positively electrically charged toner carried on the developing roller 173 contacts the photosensitive drum 168 as the developing roller 173 rotates. Thus, toner is transferred from the developing roller 173 onto the electrostatic latent image on the photosensitive drum 168, thereby visualizing the image. Image development is thus accomplished. The visualized image on the photosensitive drum 168 is transferred to the intermediate transfer drum 171. The intermediate transfer drum 171 is disposed in such a manner that the intermediate transfer drum 171 faces the photosensitive drum 168 and is rotatable. The intermediate transfer drum 171 is supplied with a predetermined transfer bias.

Thus, as the rotatable developing unit 169 rotates, the developing rollers 173 of the developing cartridges 177 sequentially come to face the photosensitive drum 168, so that a color image is formed on the intermediate transfer drum 171. For example, when the developing roller 173 of the cyan developing cartridge 177C comes to face the photosensitive drum 168 as the rotatable developing unit 169 rotates, the cyan toner from the cyan developing cartridge 177C is used to form on the photosensitive drum 168 a visible image, which is then transferred to the intermediate transfer drum 171. When the developing roller 173 of the magenta developing cartridge 177M comes to face the photosensitive drum 168 as the rotatable developing unit 169 rotates, the magenta toner from the magenta developing cartridge 177M is used to form on the photosensitive drum 168 a visible image, which is then transferred to the intermediate transfer drum 171, more specifically, superimposed on the cyan toner image on the intermediate transfer drum 171. Similar operations are repeated with the yellow toner from the yellow developing cartridge 177Y, and the black toner from the black developing cartridge 177K, to form a color image on the intermediate transfer drum 171.

The color image thus formed on the intermediate transfer drum 171 is altogether transferred to a print sheet 153 while the print sheet 153 is passing between the intermediate transfer drum 171 and the transfer roller 172, which is rotatably disposed facing the intermediate transfer drum 171 and is supplied with a predetermined bias.

After being transferred onto the print sheet 153, the color image is fixed while the print sheet 153 is passing between a heat roller 181 and a pressing roller 182 of the fixing unit 161 disposed downstream of the developing unit 160. After that, the print sheet 153 is conveyed by pairs of eject rollers 183, 184, 185, and is then ejected onto an output tray 186.

Cleaner boxes 188 each having a rotatable cleaner brush 187 are disposed sideways from the photosensitive drum 168 and the intermediate transfer drum 171, respectively. The cleaner brush 187 of each cleaner box 188 is supplied with a predetermined bias voltage with respect to the photosensitive drum 168 and the intermediate transfer drum 171, so that the cleaner brushes 187 can recover toner after development and transfer of an image.

Since the charge control agent used in the embodiment is a transparent and colorless charge control resin, the laser color printer 151 is able to easily form a color image by using color toners each containing a yellow, magenta, cyan or black coloring agent for development of an image of each color, and superimposing visible images of color toners on the intermediate drum. Furthermore, each color toner is sufficiently friction-electrically charged due to contact with the silicone rubber-made pressing portion 180 of the layer thickness-regulating blade 174, so that an image of each color toner is developed in a good manner without a development defect caused by an electrical charging characteristic defect. Thus, the laser color printer 151 is able to form a high-quality full-color image on a print sheet 153.

Although the above embodiment employs the positively electrically charged toners, it is also possible to use negatively electrically charged toners. It is also possible to use pulverized toners instead of polymerized toners. If negatively electrically charged toners are used, it may be advisable that the toner contain a charge control resin having an anionic functional group.

Toners as mentioned above are applicable not only to an intermediate-transfer laser printer as described above but also to a tandem type color laser printer.

EXPERIMENTAL EXAMPLES

Experimental examples will be described below.

1) Developing Device and Method

A developing device having components as described below was used.

Photosensitive Drum

A positively electrically charged photosensitive drum was incorporated in the developing device.

Developing Roller

A developing roller having a fluorine-based surface coat layer formed on an electrically conductive urethane rubber roller part and having an entire body resistance of $10^6$ Ω was incorporated.

Supplying Roller

A supplying roller formed from an electrically conductive open-cell urethane foam rubber was incorporated.

Toner

Positively electrically charged non-magnetic single-component toners each containing, as a main component, a styrene-acryl copolymer produced through suspension polymerization and further containing a quaternary ammonium salt-containing styrene-acryl copolymer as a charge control agent, and containing carbon and wax, were used.

Layer Thickness-Regulating Member

Three types of layer thickness-regulating members as described below were used.

Silicone Rubber

One type of layer thickness-regulating member was a silicone rubber member having a sectional shape of a semicircle of 3.5 mm in diameter and formed together with a stainless steel thin plate of 0.1 mm in thickness.

Urethane Rubber

Another type was a urethane rubber member having a sectional shape of a semicircle of 3.5 mm in diameter and formed together with a stainless steel thin plate of 0.1 mm in thickness.

Stainless Steel

The third type of layer thickness-regulating member was a bent portion (curvature of 0.3 mm) of stain steel formed by bending a thin stainless steel plate of 0.1 mm in thickness approximately to the right angle so that the bent portion functioned to scrape toner.

The developing method employed was a generally termed contact reversal development method based on contact between a developing roller and a photosensitive drum.

2) Evaluation

The three types of layer thickness-regulating members, the silicone rubber member, the urethane rubber member, and the stainless steel member, were evaluated by measuring print fogging occurring with the use of each of the members.

The print fogging was measured for each layer thickness-regulating blade member after image development was performed using the layer thickness-regulating blade member, by collecting toner deposited on the photosensitive drum through the use of a piece of an adhesive tape (so-called mending tape), and sticking the piece of tape onto white paper, and sticking another piece of the same adhesive tape that was not brought into contact with toner on the photosensitive drum onto the same white paper as a blank sample, and then measuring the reflectivity (%) of each piece of tape, and determining the reflectivity difference between the two pieces of tape. The reflectivity difference is attributed to toner deposited on the photosensitive drum. A greater reflectivity difference indicates a greater degree of fogging. The allowance of the reflectivity difference is 2 or less. Results are shown in Table 4.

TABLE 4

| Material of layer thickness-regulating member | Reflectivity difference (ΔY) |
|---|---|
| Silicone rubber | 0.2 |
| Urethane rubber | 3.5 |
| Stainless steel | 3.0 |

Table 4 indicates that the layer thickness-regulating silicone rubber member caused almost no fogging. Visual observation of the pieces of tape stuck on the white paper verified that the silicone rubber member did not caused fogging.

It is to be understood that the invention is not restricted to the particular forms shown in the foregoing embodiment. Various modifications and alternations can be made thereto without departing from the scope of the invention.

What is claimed is:

1. A development device, comprising:

a developing agent carrier that carries thereon a non-magnetic single-component developing agent, the developing agent containing a charge control resin for providing an electrical charging characteristic, the charge control resin is a resin produced by copolymerizing an ionic monomer having an ionic functional group, and a copolymerizable monomer that is copolymerizable with the ionic monomer; and a layer thickness-regulating member that presses a surface of the developing agent carrier, and forms a thin layer of the developing agent on the developing agent carrier, wherein a pressing portion of the layer thickness-regulating member at which the layer thickness-regulating member presses the surface of the developing agent carrier is formed from a silicone rubber, and a pressing force with which the pressing portion presses the surface of the developing agent carrier is within a range of approximately 15 gf/cm to approximately 30 gf/cm.

2. The developing device according to claim 1, wherein the surface of the developing agent carrier is formed from an electrically conductive elastic material.

3. The developing device according to claim 2, wherein the electrically conductive elastic material is one of urethane rubber or silicone rubber.

4. The developing device according to claim 2, wherein the elastic material contains fluorine.

5. The developing device according to claim 1, wherein the developing agent is a polymerized toner produced by polymerizing a polymerizable monomer.

6. The developing device according to claim 1, wherein a surface roughness of the surface of the developing agent carrier is less than a mean particle size of the developing agent.

7. The developing device according to claim 1, wherein the developing agent contains at least two kinds of external additives that are different in particle size.

8. The developing device according to claim 7, wherein the external additive having a relatively large particle size from the other kind of external additive, has a BET specific surface area that is less than 100 $m^2/g$.

9. The developing device according to claim 7, wherein the at least two kinds of external additives include an external additive having a BET specific surface area of 200 $m^2/g$ and an external additive having a BET specific surface area of 50 $m^2/g$.

10. The developing device according to claim 1, wherein the ionic functional group includes a quarternary ammonium salt, and the copolymerizable monomer includes a styrene-based monomer and an acryl-based monomer.

11. A cartridge, comprising:

a developing agent storage chamber that contains a non-magnetic single-component developing agent, the developing agent containing a charge control resin for providing an electrical charging characteristic, the charge control resin is a resin produced by copolymerizing an ionic monomer having an ionic functional group, and a copolymerizable monomer that is copolymerizable with the ionic monomer;

a developing agent carrier that carries thereon the non-magnetic single-component developing agent;

a supplying member that supplies the developing agent from the developing agent storage chamber to the developing agent carrier; and a layer thickness-regulating member that presses a surface of the developing agent carrier, and forms a thin layer of the developing agent on the developing agent carrier, wherein a pressing portion of the layer thickness-regulating member at which the layer thickness-regulating member presses the surface of the developing agent carrier is formed from a silicone rubber, and a pressing force with which the pressing portion presses the surface of the developing agent carrier is within a range of about 15 gf/cm to about 30 gf/cm.

12. The cartridge according to claim 11, wherein the developing agent is a polymerized toner produced by polymerizing a polymerizable monomer.

13. The cartridge according to claim 11, wherein the cartridge is detachably removable from a cartridge that includes a photosensitive drum.

14. An image forming apparatus comprising:

a cartridge according to claim 11, and an electrostatic latent image carrier being disposed facing the developing agent carrier, wherein an electrostatic latent image is formed on the electrostatic latent image carrier.

15. The image forming apparatus according to claim 14, wherein the developing agent is a polymerized toner produced by polymerizing a polymerizable monomer.

16. The image forming apparatus according to claim 14, the cartridge farther comprising a developing chamber that contains the developing agent carrier and the layer thickness-regulating member, and an opening portion via which the developing agent storage chamber and the developing chamber communicate with each other.

17. The image forming apparatus according to claim 16, further comprising a developing agent amount detector that detects a state that an amount of the developing agent remaining in the developing agent storage chamber is substantially equal to an amount of the developing agent that is allowed to exist in the developing chamber.

18. A developing device, comprising:

a developing agent carrier that carries thereon a non-magnetic single-component developing agent, the developing agent containing a charge control resin for providing an electrical charging characteristic, the charge control resin is a resin produced by copolymerizing an ionic monomer having an ionic functional group, and a copolymerizable monomer that is copolymerizable with the ionic monomer; and a layer thickness-regulating member that presses a surface of the developing agent carrier, and that forms a thin layer of the developing agent on the developing agent carrier, wherein a pressing portion of the layer thickness-regulating member at which the layer thickness-regulating member presses the surface of the developing agent carrier is formed from a silicone rubber.

19. The developing device according to claim 18, wherein the developing agent is a polymerized toner produced by polymerizing a polymerizable monomer.

20. The developing device according to claim 18, wherein the ionic functional group includes a quarternary ammonium salt, and the copolymerizable monomer includes a styrene-based monomer and an acryl-based monomer.

21. The developing device according to claim 18, wherein the surface of the developing agent carrier is formed from an electrically conductive elastic material.

22. The developing device according to claim 21, wherein the electrically conductive elastic material contains is one of urethane rubber or silicone rubber.

23. The developing device according to claim 18, wherein the elastic material contains fluorine.

24. The developing device according to claim 18, wherein a surface roughness of the surface of the developing agent carrier is less than a mean particle size of the developing agent.

25. The developing device according to claim 18, wherein the developing agent contains at least two kinds of external additives that are different in particle size.

26. The developing device according to claim 25, wherein the external additive, having a relatively large particle size from the other kind of external additive, has a BET specific surface area that is less than 100 $m^2/g$.

27. The developing device according to claim 25, wherein the at least two kinds of external additives include an external additive having a BET specific surface area of 200 $m^2/g$ and an external additive having a BET specific surface area of 50 $m^2/g$.

28. An image forming device, comprising:

a developing agent storage chamber that contains a non-magnetic single-component developing agent;

a developing agent carrier that carries thereon the non-magnetic single-component developing agent;

a supplying member that supplies the developing agent from the developing agent storage chamber to the developing agent carrier;

a layer thickness-regulating member that presses a surface of the developing agent carrier, and forms a thin layer of the developing agent on the developing agent carrier;

a developing chamber that contains the developing agent carrier and the layer thickness-regulating member, and an opening portion via which the developing agent storage chamber and the developing chamber communicate with each other; and a developing agent amount detector that detects a state that an amount of the developing agent remaining in the developing agent storage chamber is substantially equal to an amount of the developing agent that is allowed to exist in the developing chamber.

29. The image forming apparatus according to claim 28, wherein the developing agent amount detector detects the state that the amount of the developing agent remaining in the developing agent storage chamber is greater than the amount of the developing agent that is allowed to exist in the developing chamber.

30. A cartridge, comprising:

a developing agent carrier that carries thereon a non-magnetic single-component developing agent, the developing agent containing a charge control resin for providing an electrical charging characteristic, the charge control resin is a resin produced by copolymerizing an ionic monomer having an ionic functional group, and a copolymerizable monomer that is copolymerizable with the ionic monomer; and a layer thickness-regulating member that presses a surface of the developing agent carrier, and that forms a thin layer of the developing agent on the developing agent carrier, wherein a pressing portion of the layer thickness-regulating member at which the layer thickness-regulating member presses the surface of the developing agent carrier is formed from a silicone rubber.

* * * * *